US006653977B1

(12) United States Patent
Okabe et al.

(10) Patent No.: US 6,653,977 B1
(45) **Date of Patent: *Nov. 25, 2003**

(54) WIRELESS HANDSET

(75) Inventors: Hiroshi Okabe, Kokubunji (JP); Ken Takei, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/514,346

(22) Filed: Feb. 28, 2000

(30) Foreign Application Priority Data

Nov. 5, 1999 (JP) ..... 11-314746

(51) Int. Cl.[7] ..... H01Q 1/38
(52) U.S. Cl. ..... 343/700 MS; 343/767
(58) Field of Search ..... 343/700 MS, 702, 343/767, 770, 746

(56) References Cited

U.S. PATENT DOCUMENTS 4,114,161 A * 9/1978 Shibano ..... 343/741
5,914,691 A * 6/1999 Mandai et al. ..... 343/702
5,914,693 A * 6/1999 Takei et al. ..... 343/700 MS
6,049,310 A * 4/2000 Sadahiro ..... 343/702
6,069,589 A * 5/2000 Lewis et al. ..... 34/700 MS
6,075,491 A * 6/2000 Dakeya et al. ..... 343/700 MS
6,229,484 B1 * 5/2001 Sagisaka ..... 343/700 MS
6,427,065 B1 * 7/2002 Suga et al. ..... 455/41
6,462,714 B1 * 10/2002 Okabe et al. ..... 343/767

* cited by examiner

*Primary Examiner*—Don Wong
*Assistant Examiner*—Shih-Chao Chen

(57) ABSTRACT

To provide a novel wireless handset achieving downsized formation and promotion of performance by using independent antennas for transmission and receiving and restraining interference between the antennas for transmission and the antennas for receiving in a communication system. In the communication system, different frequencies for transmission and receiving are simultaneously used, in a wireless handset used in the communication system in which the different frequencies for transmission and for receiving are simultaneously used, a magnetic current antenna for transmission and a magnetic current antenna for receiving are arranged in parallel with each other such that respective magnetic currents are disposed on a straight line.

21 Claims, 13 Drawing Sheets

WIRELESS HANDSET

BACKGROUND OF THE INVENTION

The present invention relates to a wireless handset, particularly to a wireless handset mounted with independent antennas for transmission and for receiving preferable for a wireless handset used in a communication system in which different frequencies for transmission and for receiving are simultaneously used.

Currently and generally, according to a wireless handset used in a communication system in which different frequencies for transmission and for receiving are simultaneously used, in order to carry out transmission and receiving by a single antenna, there is provided a duplexer between a transmission system circuit and a receiving system circuit and an antenna such that a transmitted signal is directed to the antenna but is not directed to the receiving system circuit and a received signal is directed from the antenna to the receiving system circuit but is not directed to the transmission system circuit. According to such a constitution constructed by the antenna, the duplexer and the transmission/receiving systems, transmission power is lost in the transmission system and minimum receiving power sensitivity is restricted in the receiving system by insertion loss of the duplexer. Loss of passband is increased when an attenuation amount of stopband is intended to sufficiently ensure in a communication system having a wide transmission and receiving bandwidth, particularly a communication system in which frequency interval for transmission and receiving is near, that is, a frequency interval of passband and stopband in a transmission or receiving filter of the duplexer is near. Loss of transmission power in a wireless handset gives rise to a need of ensuring extra battery capacity and hampers downsized formation necessary for the wireless handset. Further, loss of receiving power deteriorates the minimum receiving power sensitivity and hampers promotion of function of wireless device.

SUMMARY OF THE INVENTION

Hence, according to a conventional wireless handset, there is proposed a constitution in which independent narrow band antennas are provided respectively for a transmission and a receiving system, the antennas are directly connected to a transmission system circuit and a receiving system circuit to thereby enable to downsize the handset and promote its function in Japanese Patent Laid-open (Kokai) No. Hei 11-251948. An example of the constitution is shown by FIG. 13.

In FIG. 13, numeral 200 designates a circuit board of a wireless handset and numerals 210 and 220 designate a transmission system circuit and a receiving system circuit respectively provided on the circuit board 200. A transmitted signal generated by the transmission system circuit 210 is radiated to space from a built-in antenna 160 in which only transmission frequency band constitutes passband via a radio frequency (RF) filter for transmission 301. A signal to be received in space is caught by a helical antenna 170 in which only receiving frequency band constitutes passband when an exterior antenna is contained and is transmitted from an exterior antenna electricity feed point 172 above the circuit board 200 connected to an electricity feed point 171 of the helical antenna to the receiving system circuit 220 via a receiving radio frequency (RF) filter 302. When the exterior antenna is extended, by connecting the exterior antenna electricity feed point 172 to an electricity feed point 174 of a monopole antenna 173 in which only the receiving frequency band constitutes passband, a signal caught by the monopole antenna 173 is transmitted to the receiving system circuit 220.

According to the constitution, the built-in antenna 160 and the helical antenna 170 or the monopole antenna 173 which is the exterior antenna are constructed by constitutions of narrow band. That is, gain is low at a received frequency in the antenna for transmission and sensitivity is low at a transmitted frequency in the antenna for receiving and accordingly, an attenuation amount at stopband is not so much needed in the radio frequency (RF) filters 301 or 302 provided between the antennas and the transmission system circuit 210 or the receiving system circuit 220. In the case of a filter in which the attenuation amount at stopband is not so much needed, the insertion loss can be restrained low. Therefore, the wireless handset according to the constitution realizes downsized formation by reducing battery capacity by reducing loss of transmission power and realizes promotion of the minimum receiving power sensitivity by reducing loss of receiving power.

According to the conventional wireless handset proposed in Japanese Patent Laid-open (Kokai) No. Hei 11-251948, the transmission and receiving antennas are respectively constructed by the constitutions in narrow band and accordingly, the attenuation amounts at stopband of the radio frequency (RF) filters respectively for transmission and receiving provided respectively between the transmission and receiving antennas and the transmission and receiving circuits may be restrained low. However, even the antenna of narrow band is provided with more or less sensitivity in near frequency band and accordingly, there poses a problem in a communication system in which frequency intervals for transmission and receiving are near to each other, in which the antenna for transmission is provided with more or less sensitivity in receiving band and the antenna for receiving is provided with more or less sensitivity in transmission band, the attenuation amount of stopband of the radio frequency (RF) filter cannot be restrained low in the conventional constitution of the wireless handset and accordingly, the insertion loss cannot be reduced.

It is an object of the present invention to provide a novel wireless handset achieving downsized formation and promotion of function by using independent antennas for transmission and receiving and restraining interference between the transmission and receiving antennas in a communication system in which different and near frequencies for transmission and for receiving are simultaneously used.

The above-described problem of the present invention can effectively be resolved by providing a magnetic current antenna for transmission and a magnetic current antenna for receiving arranged in parallel with each other such that respective magnetic currents are disposed on a straight line in a wireless handset used in a communication system in which different frequencies for transmission and for receiving are simultaneously used.

A plurality of magnetic current antennas can mostly reduce interference among magnetic antennas when the antennas are arranged such that magnetic currents are aligned in a straight line and accordingly, when the magnetic current antennas for transmission and for receiving are arranged in parallel with each other such that respective magnetic currents are disposed on a straight line, interference among the antennas for transmission and for receiving is minimized and there can be reduced signal leakage from a radio frequency circuit for transmission to a radio frequency circuit for receiving which becomes problematic in a wireless handset simultaneously carrying out transmission and receiving. When the signal leakage among the radio frequency circuits for transmission and for receiving is small, there can be reduced attenuation amounts of stopband in radio frequency filters respectively provided between the antennas for transmission and for receiving and the transmission and receiving circuits. Generally, a radio frequency filter having a small attenuation amount of stopband can be fabricated with small loss of passband. Therefore, by adopting such a means, a wireless handset can be downsized by reducing battery capacity since power loss in transmission is reduced and minimum receiving power sensitivity function of a wireless handset can be promoted since power loss of receiving can be reduced.

Further, the above-described problem of the present invention can effectively be resolved by providing antennas, a control circuit for changing central frequencies of impedance matching of the antennas and band-switching filter circuits which are connected to the antennas and bands of which are switched by the control circuit.

In a communication system, bandwidth used for operation is generally narrower than bandwidth of a total of a system. Therefore, by changing central frequency of impedance matching of an antenna in compliance with operating frequency, an antenna having narrow bandwidth can be used. Generally, bandwidth of an antenna is proportional to a volume thereof and accordingly, an antenna having narrow bandwidth can be realized in a small size. Similarly, by switching band of a filter in compliance with operating frequency, a filter having narrow bandwidth can be used. When passband is not extremely narrower than used frequency, generally, a filter having narrow bandwidth can be realized such that insertion loss is smaller than that of a filter having wide bandwidth. Therefore, by adopting such a means, a small-sized antenna and a filter having small insertion loss can be used by simultaneously controlling the antenna and the filter by a common control circuit and accordingly, the sensitivity for receiving can be promoted while further downsizing a wireless handset.

Further, according to a wireless handset which has an antenna for transmission and an antenna for receiving and in which directions of main polarization of the antenna for transmission and the antenna for receiving are the same, insertion loss of radio frequency filters respectively provided between the antennas for transmission and receiving and transmission and receiving circuits can be reduced, further, directions of main polarization of the antennas for transmission and receiving can be aligned to a direction of polarization used in a system in which the wireless handset is used and accordingly, transmission and receiving can be carried out efficiently.

These and other objects and many of the attendant advantages of the invention will be readily appreciated as the same becomes better understood by reference to the following detailed description when considered in connection with the accompanying drawings.

DETAILED DESCRIPTION OF THE PREFERRED EMBODIMENTS

A further detailed explanation will be given of embodiments of wireless handsets according to the present invention in reference to several examples shown by the drawings as follows. Further, the same notation in FIG. 1 through FIG. 12 designates the same member or similar member.

Embodiment 1

Figure 1:
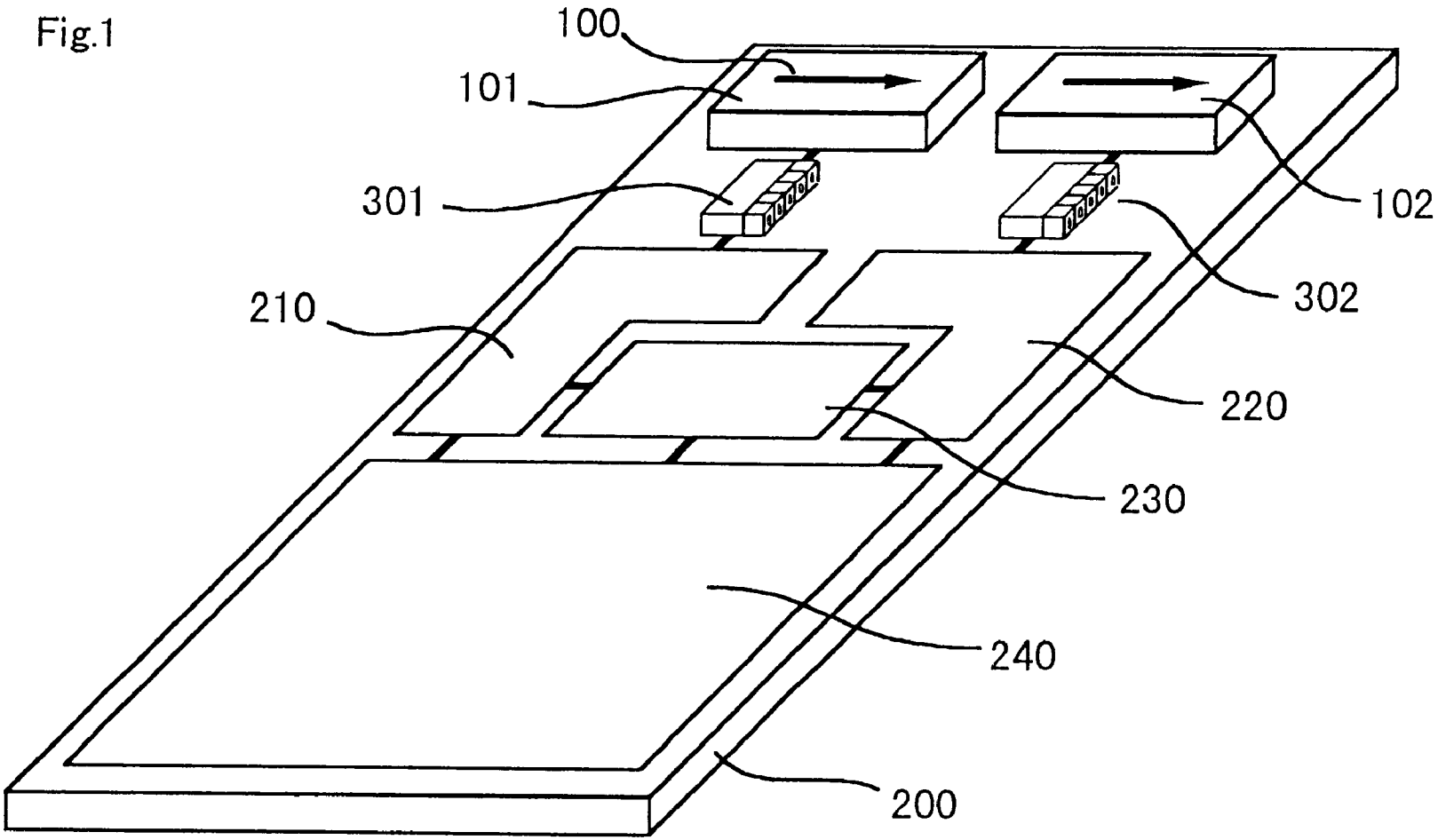
FIG. 1 is a perspective view for explaining a first embodiment of a wireless handset according to the present invention.

FIG. 1 shows an embodiment in which in a wireless handset used in a communication system in which different frequencies for transmission and for receiving are simultaneously used, a magnetic current antenna for transmission and a magnetic current antenna for receiving are arranged in parallel with each other such that respective magnetic currents are disposed on a straight line and directions of main polarization of the magnetic current antennas for transmission and for receiving are made the same direction. In FIG. 1, numeral 101 designates a magnetic current antenna for transmission, numeral 102 designates a magnetic current antenna for receiving, numeral 301 designates a filter for transmission, numeral 302 designates a filter for receiving, numeral 210 designates a radio frequency circuit for transmission, numeral 220 designates a radio frequency circuit for receiving, numeral 230 designates a synthesizer and numeral 240 designates a logical circuit portion and all of these are arranged on a circuit board 200. Further, in the drawing, with regard to elements of a cabinet, a microphone, a speaker and the like constituting the wireless handset, illustration thereof is omitted. The magnetic current antenna for transmission is connected to the radio frequency circuit for transmission via the filter for transmission and the magnetic current antenna for receiving is connected to the high frequency circuit for receiving via the filter for receiving. Both of the radio frequency circuits for transmission and for receiving are connected to the synthesizer and the logical circuit portion.

The magnetic current antennas for transmission and for receiving are arranged in parallel with each other such that magnetic currents shown by an arrow mark 100 are aligned on a straight line. When a plurality of magnetic current antennas are arranged such that magnetic currents are aligned on a straight line, interference among antennas are minimized and accordingly, by arranging the two magnetic current antennas such that the magnetic currents are aligned on the straight line as in the embodiment, interference between the antennas for transmission and for receiving is minimized and at the same time, there can be reduced signal leakage from the radio frequency circuit for transmission to the radio frequency circuit for receiving which becomes problematic in the wireless handset carrying out transmission and receiving simultaneously. Thereby, attenuation amounts of stopband of the radio frequency filters respectively provided between the antennas for transmission and for receiving and the circuits for transmission and receiving, are reduced and improved and accordingly, radio frequency filters having low insertion loss can be used therefor and there can be realized downsized formation of the wireless handset using a small-sized battery having small capacity owing to a reduction in loss of transmission power and promotion of the minimum receiving power sensitivity of the wireless handset owing to a reduction in loss of receiving power.

Further, normally, polarized wave used in a wireless handset is vertically polarized wave and accordingly, a direction of main polarization necessary for the wireless handset in this example which is used such that a longitudinal direction of the circuit board 200 is directed in the up and down direction, is directed in a direction in parallel with the longitudinal direction of the circuit board. Therefore, by aligning directions of main polarization of the antennas for transmission and for receiving respectively in the direction in parallel with the longitudinal direction of the circuit board, while using the independent antennas for transmission and for receiving, transmission and receiving can efficiently be carried out in compliance with the polarization direction set by the system. The direction of main polarization of the magnetic current antenna is orthogonal to the direction of the magnetic current designated by the arrow mark 100 in the drawing. Accordingly, the direction of the magnetic current of the magnetic current antenna in which the direction of the main polarization is aligned in the direction in parallel with the longitudinal direction of the circuit board, becomes orthogonal to the longitudinal direction of the circuit board. In this case, when the magnetic current antennas for transmission and for receiving are arranged in parallel with each other in the direction orthogonal to the longitudinal direction of the circuit board, the magnetic currents can be aligned on the straight line while aligning the directions of the main polarization of the two antennas.

Figure 2C:
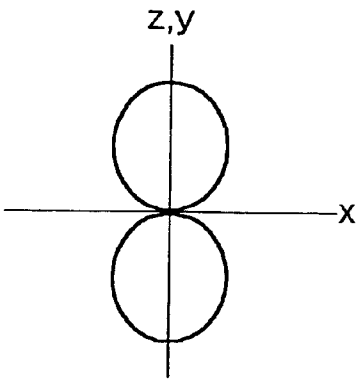
FIG. 2C shows antenna radiation pattern (x-y plane and x-z plane) for explaining antenna characteristics according to the first embodiment.
Figure 2B:
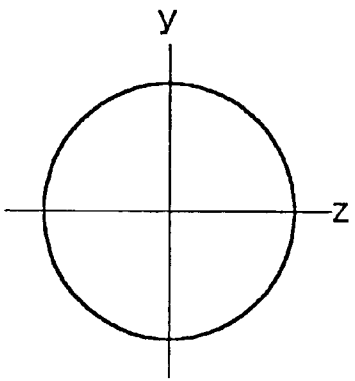
FIG. 2B shows antenna radiation pattern (z-y plane) for explaining antenna characteristics according to the first embodiment.
Figure 2A:
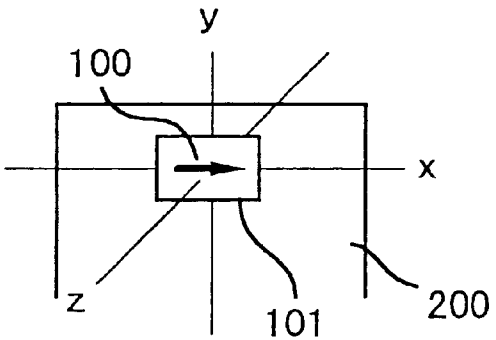
FIG. 2A is a view for explaining coordinate system of a circuit board of a wireless handset and an antenna.

Here, an explanation will be given of a reduction in interference between magnetic current antennas in reference to FIGS. 2A, 2B and 2C. FIG. 2A shows the coordinate system of the circuit board of the wireless handset and the antenna, FIG. 2B shows an antenna radiation pattern of z-y plane and FIG. 2C shows an antenna radiation pattern of x-y plane and x-z plane. In FIG. 2A, numeral 101 designates the magnetic current antenna and numeral 200 designates the circuit board. The circuit board plane is set to x-y plane and the longitudinal direction of the circuit board is set to y axis. The magnetic current antenna is arranged such that the direction of magnetic current designated by the arrow mark 100 becomes in parallel with x axis. The antenna radiation pattern in this case becomes non directional pattern in x-z plane as shown by FIG. 2B and becomes "8"-like pattern in which power is not radiated in the x axis direction in x-y plane and x-z plane as shown by FIG. 2C. Accordingly, in the case of the magnetic current antenna, the sensitivity is mostly weakened in the axis direction along the magnetic current and accordingly, interference among antennas can be minimized by arranging a plurality of the magnetic current antennas such that the magnetic currents are aligned on the straight line.

Embodiment 2

Figure 3:
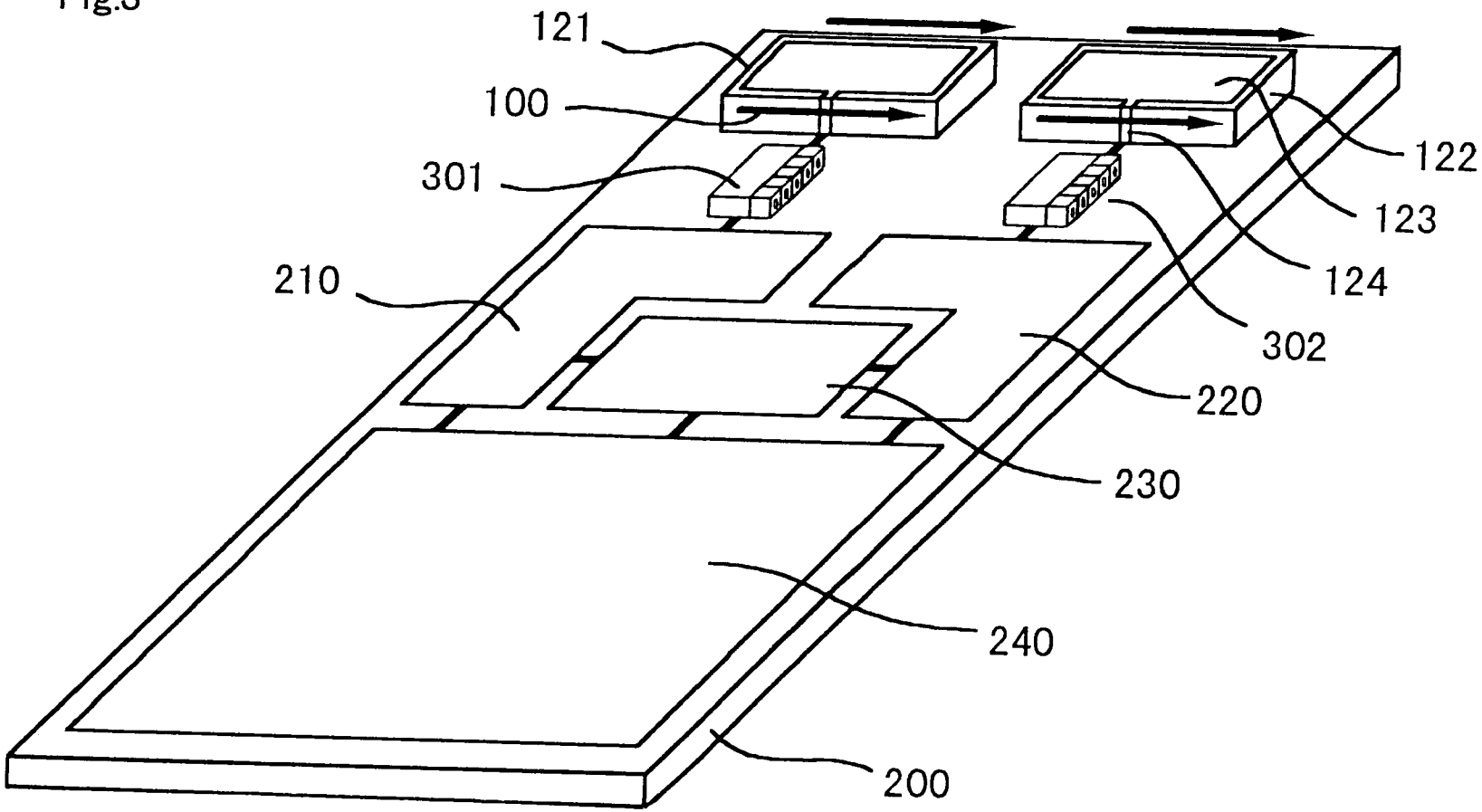
FIG. 3 is a perspective view for explaining a second embodiment of a wireless handset according to the present invention.

FIG. 3 shows a second embodiment of the present invention in which a micro strip antenna is used for the magnetic current antenna according to Embodiment 1. In FIG. 3, numeral 121 designates a micro strip antenna for transmission and numeral 122 designates a micro strip antenna for receiving. The micro strip antennas are constructed by a structure in which a ground conductor is provided on a rear face of a dielectric board, a micro strip conductor 123 in a square shape is provided on a top face thereof and electricity is fed between the micro strip conductor and the ground conductor through an electricity feed line 124. As shown by the arrow mark 100 in FIG. 2A, there are two magnetic flows contributing to power radiation in the micro strip antenna flowing between the ground conductor and an end of the micro strip conductor on the side of an electricity feed line and flowing between the ground conductor and an end of the micro strip conductor in parallel with the end of the micro strip conductor on the side of the electricity feed line and remote from the electricity feed line. Further, a direction of main polarization in the micro strip antenna is directed in a direction in parallel with the micro strip conductor and orthogonal to the two magnetic flows. Accordingly, by arranging the micro strip antennas for transmission and for receiving in parallel with each other as shown by FIG. 3, directions thereof of main polarization can be made coincident with each other and respectives of the two magnetic currents can be aligned on a straight line. The micro strip antenna according to the embodiment is an antenna in a plate-like shape and is reflow-mounted on the circuit board simultaneously with other parts. Further, the antenna is fabricated by a normal processing of fabricating a printed circuit board and accordingly, the antenna can be formed in the circuit board simultaneously with the circuit board and the cost can be reduced.

Embodiment 3

Figure 4:
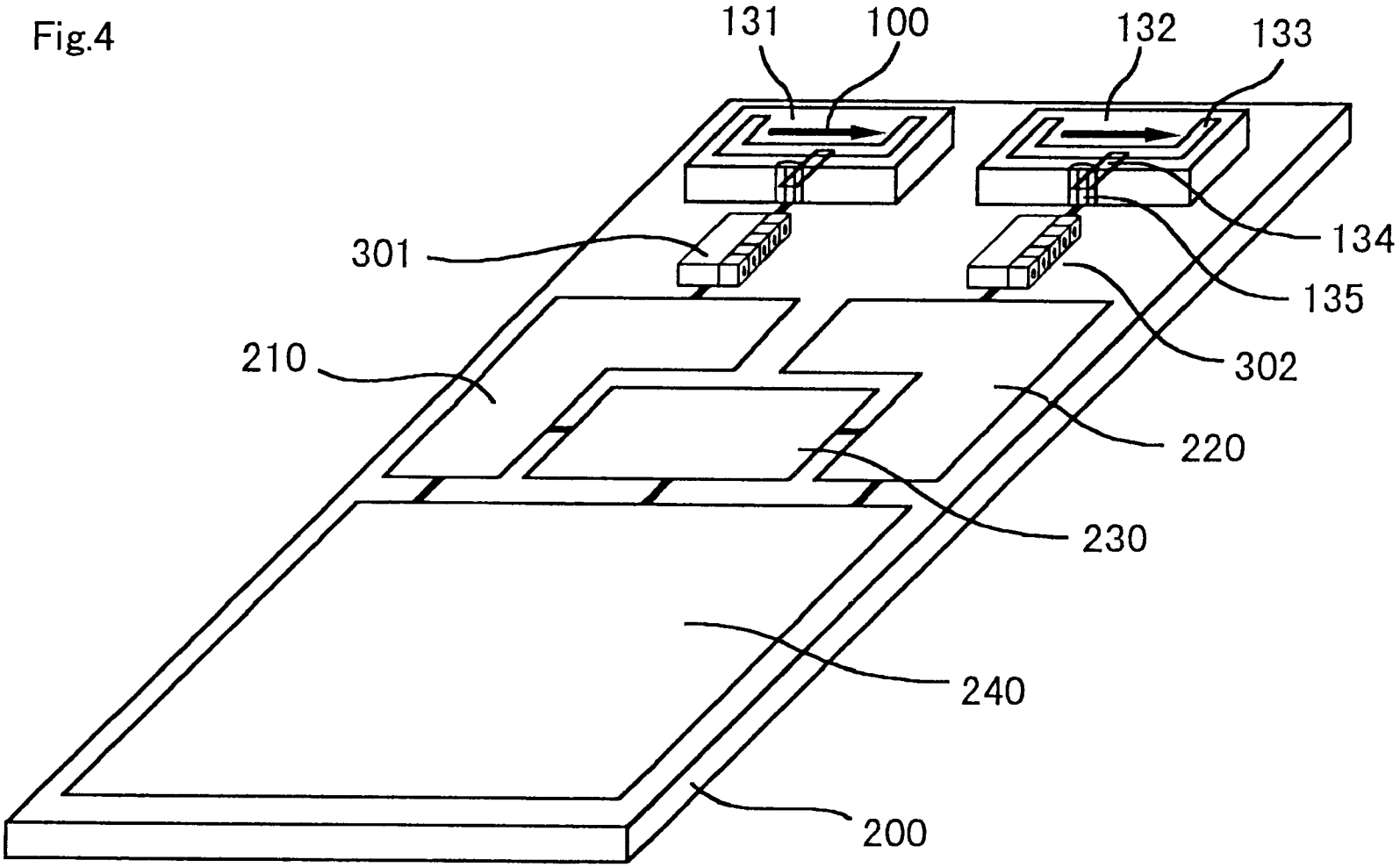
FIG. 4 is a perspective view for explaining a third embodiment of a wireless handset according to the present invention.

FIG. 4 shows a third embodiment according to the present invention in which a slot antenna is used as the magnetic current antenna according to Embodiment 1. In FIG. 4, numeral 131 designates a slot antenna for transmission and numeral 132 designates a slot antenna for receiving. The slot antennas are constructed by a structure in which a slot 133 is formed by removing a conductor from a top face of a dielectric board the surface of which is covered with a conductor wall, a strip-like conductor 134 is provided at inside of the dielectric board to intersect with the slot and electricity is fed between a side face electrode 135 provided in an island-like shape at a side face of the dielectric board such that the side face electrode 135 is not brought into contact with a conductor of the side face while being brought into contact with the strip-like conductor at the inside of the dielectric board, and the conductor wall at the surface of the dielectric board. Magnetic current in the slot antenna is generated at inside of the slot and in parallel with the slot. Magnetic current effective in the embodiment is generated at a central portion of the slot in a direction in parallel with the slot as shown by the arrow mark 100 in FIG. 3. In the case of the slot antenna having the slot, front ends of which are bent as shown by FIG. 3, a consideration needs not to give to magnetic currents generated at both end portions of the slot orthogonal to a central portion of the slot since directions of the magnetic currents are reversed in the left and right direction and the magnetic currents are canceled by each other. The direction of main polarization of the slot antenna according to the embodiment is a direction in parallel with the slot face and orthogonal to the central portion of the slot. Accordingly, by arranging the slot antennas for transmission and for receiving in parallel with each other as shown by FIG. 4, directions of main polarization thereof are made coincident with each other and the magnetic currents can be aligned on a straight line.

Further, according to the slot antenna of the embodiment, a plane thereof opposed to the slot face constitutes a ground plane and accordingly, the magnetic current generated at inside of the slot and imaginary magnetic current having the same phase generated via the ground plane, influence each other to thereby realize a single-side directional characteristic having a gain on a side opposed to the ground plane in view from the slot. According to the embodiment, the slot antenna having the single-side directionality is arranged on a face of a circuit board to provide the directionality in a direction opposed to a user in using the wireless handset. Thereby, there can be avoided influence of absorbing electromagnetic wave by the head portion of the user in the speech state of the wireless handset, which becomes significant when a frequency equal to or higher than about 2 GHz is used, power consumption can be reduced by promoting the radiation power efficiency owing to the fact that power is not radiated to the side of the user and the receiving sensitivity can be promoted by an increase in the gain of the antenna on the side opposed to the head portion. Further, since the antenna is provided with the directionality on a single side, presence or absence of parts on the circuit board disposed on the side of the head portion of the user in view from the antenna at a position of arranging the antenna, does not influence on transmission and receiving of electromagnetic wave by the antennas and accordingly, by mounting parts at the same position, a density of mounting parts can be increased and the wireless handset can further be downsized.

Figure 5C:
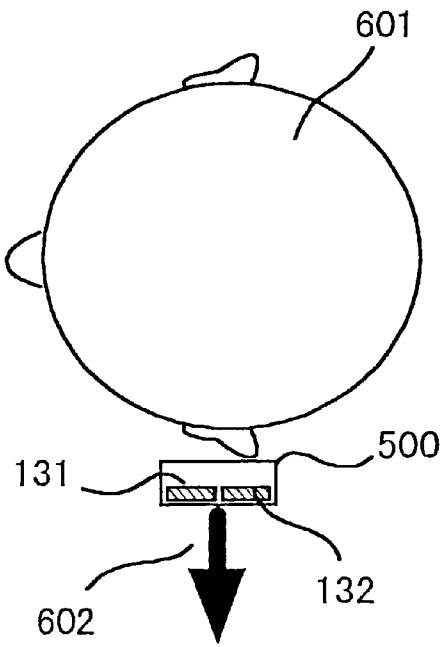
FIG. 5C is a view in view from head portion of an user of a state in which the user of the wireless handset is speaking by using the wireless handset.
Figure 5B:
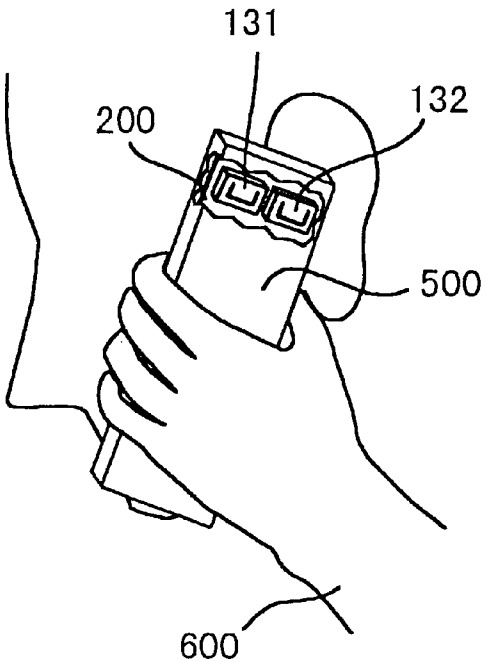
FIG. 5B is a side view of a state in which an user of a wireless handset is speaking by using the wireless handset.
Figure 5A:
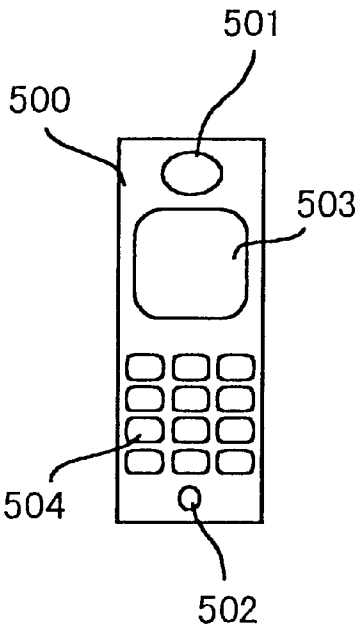
FIG. 5A is a front view of a wireless handset for explaining a relationship between antenna arrangement and a user according to the third embodiment.

An explanation using FIGS. 5A, 5B and width 5C will be given of a positional relationship between a position of mounting the slot antennas for transmission and for receiving and the user of the wireless handset in this case. FIG. 5A is a front view of a wireless handset, FIG. 5B is a side view of a state in which the user of the wireless handset is speaking by using the wireless handset and FIG. 5C illustrates a view in view from the head portion of the user. In FIG. 5A, numeral 500 designates a cabinet of the wireless handset, numeral 501 designates a speaker, numeral 502 designates a microphone, numeral 503 designates a display, numeral 504 designates a key pad, numeral 200 designates the circuit board in the cabinet, numeral 131 designates the slot antenna for transmission, numeral 132 designates the slot antenna for receiving, numeral 600 designates the hand of the user and numeral 601 designates the head portion of the user. Further, the cabinet 500 in FIG. 5B is illustrated in a form in which the cabinet 500 is partially cut such that positions of the antennas in the cabinet can be known. Generally, as shown by FIG. 5A, the wireless handset is arranged with the speaker at a vicinity of an upper end thereof and the microphone at a vicinity of a lower end thereof, and arranged with the display on an upper side between the microphone and the speaker and the key pad on a lower side therebetween with a longitudinal direction thereof directed in the up and down direction. Therefore, the user directs a face arranged with the microphone, the speaker, the display and the key pad to a side of the face and speeches by disposing the upper end on the upper side and gripping the lower side of the wireless handset having the key pad as shown by FIG. 5B.

According to the example, the slot antennas for transmission and receiving having the single-side directionality is arranged on the circuit board proximate to the upper end of the wireless handset on the side opposed to the head portion of the user as shown by FIG. 5B and width accordingly, the antennas are effectively provided with gain and sensitivity on the side opposed to the head portion of the user absorbing electromagnetic wave and further, a possibility of deteriorating the gain and sensitivity by being covered by the hand of the user can be reduced.

Embodiment 4

Figure 6:
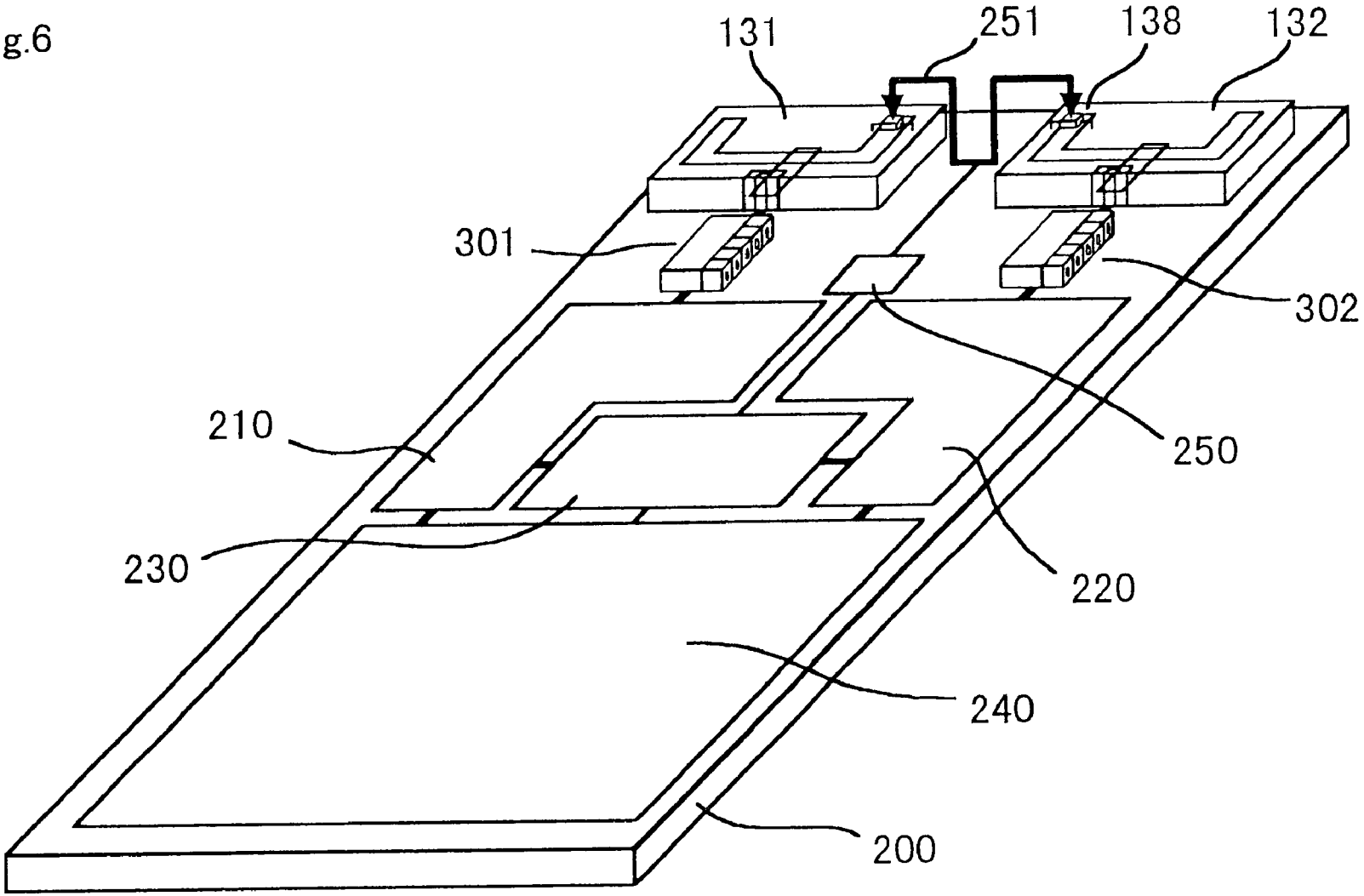
FIG. 6 is a perspective view for explaining a fourth embodiment of a wireless handset according to the present invention.

FIG. 6 shows an example of a wireless handset provided with a control circuit for changing the central frequency of impedance matching of the slot antenna in Embodiment 3 in compliance with operating frequency. FIG. 6 illustrates the antenna for transmission 131 and the antenna for receiving 132 parallelly arranged with each other in parallel with a short side of the circuit board 200 in a rectangular shape, variable impedance circuits 138 respectively provided to the antenna for transmission 131 and the antenna for receiving 132 and a control circuit 250 connected to the variable impedance circuits 138. The control circuit 250 is provided in a region sandwiched between the antenna for transmission 131 and the antenna for receiving 132 or a region extended from the region in parallel with a long side of the circuit board 200. The synthesizer 230 generates a specific locally-oscillated frequency signal by data provided from the logical circuit portion 240. The logical circuit portion transmits a signal to the radio frequency circuit for transmission 210, the radio frequency circuit for transmission subjects the signal to frequency conversion into an operating frequency signal for transmission by the locally-oscillated frequency signal transmitted from the synthesizer and radiates the signal from the slot antenna for transmission 131 to space via the filter for transmission 301. In the meantime, an operating frequency signal for receiving received by the slot antenna for receiving 132 is transmitted to the radio frequency circuit for receiving 220 via the filter for receiving 302 and the radio frequency circuit for receiving subjects the operating frequency signal for receiving to frequency conversion by the locally-oscillated frequency signal transmitted from the synthesizer to thereby carry out receiving. The control circuit 250 controls impedance of the variable impedance circuits 138 on the slot antennas for transmission and for receiving via a control line 251 based on frequency information from the synthesizer. When the impedance of the variable impedance circuits are changed, central frequencies of impedance matching of the slot antennas for transmission and for receiving are changed.

Figure 7B:
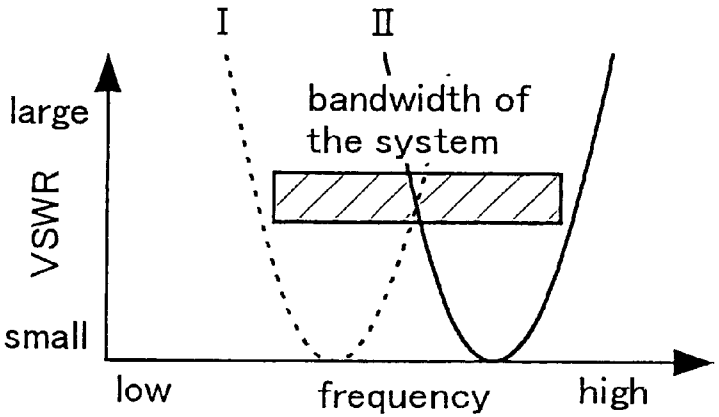
FIG. 7B shows antenna matching characteristics for explaining an antenna tuning system according to the fourth embodiment.
Figure 7A:
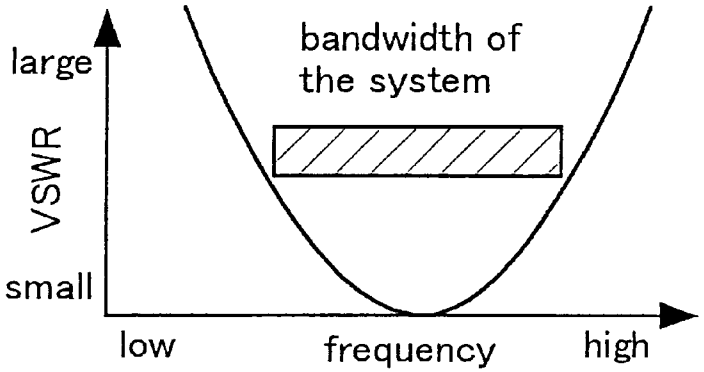
FIG. 7A shows antenna matching characteristics for explaining a behavior of covering a total of a system band by a fixed frequency antenna.

A bandwidth used in operation by the wireless handset is much narrower than system bandwidth respectively for transmission and receiving. Such a wireless handset can be applied with an antenna tuning system using a central frequency of impedance matching of a narrow bandwidth antenna having a bandwidth covering carrier bandwidth by tuning the central frequency to operating frequency. An explanation will be given of the antenna tuning system in reference to FIGS. 7A and 7B. FIGS. 7A and 7B show a matching characteristic of an antenna (frequency versus VSWR:voltage standing wave ratio) in which FIG. 7A shows a behavior of covering a total of a system band by a fixed frequency antenna and FIG. 7B shows a behavior of equivalently covering the system band by the antenna tuning system. For example, in the case in which a central frequency of impedance matching of a narrow band antenna is switched to two states of I/II by the antenna tuning system, when halves of the system band can be covered by the two states, the total of the system band can be covered equivalently. At this occasion, the bandwidth of the narrow bandwidth antenna can be made about a half of the bandwidth of the fixed frequency antenna shown by FIG. 7A. Generally, the bandwidth of an antenna is proportional to a volume thereof and accordingly, an antenna having a half bandwidth can be realized by about a half of the volume. Therefore, the wireless handset can further be downsized by the constitution. Further, when the bandwidths of antennas are narrowed, interference between the antennas for transmission and for receiving is reduced and accordingly, an attenuation amount in a stopband of a radio frequency filter can further be reduced and a radio frequency filter having less insertion loss can be adopted.

Figure 8:
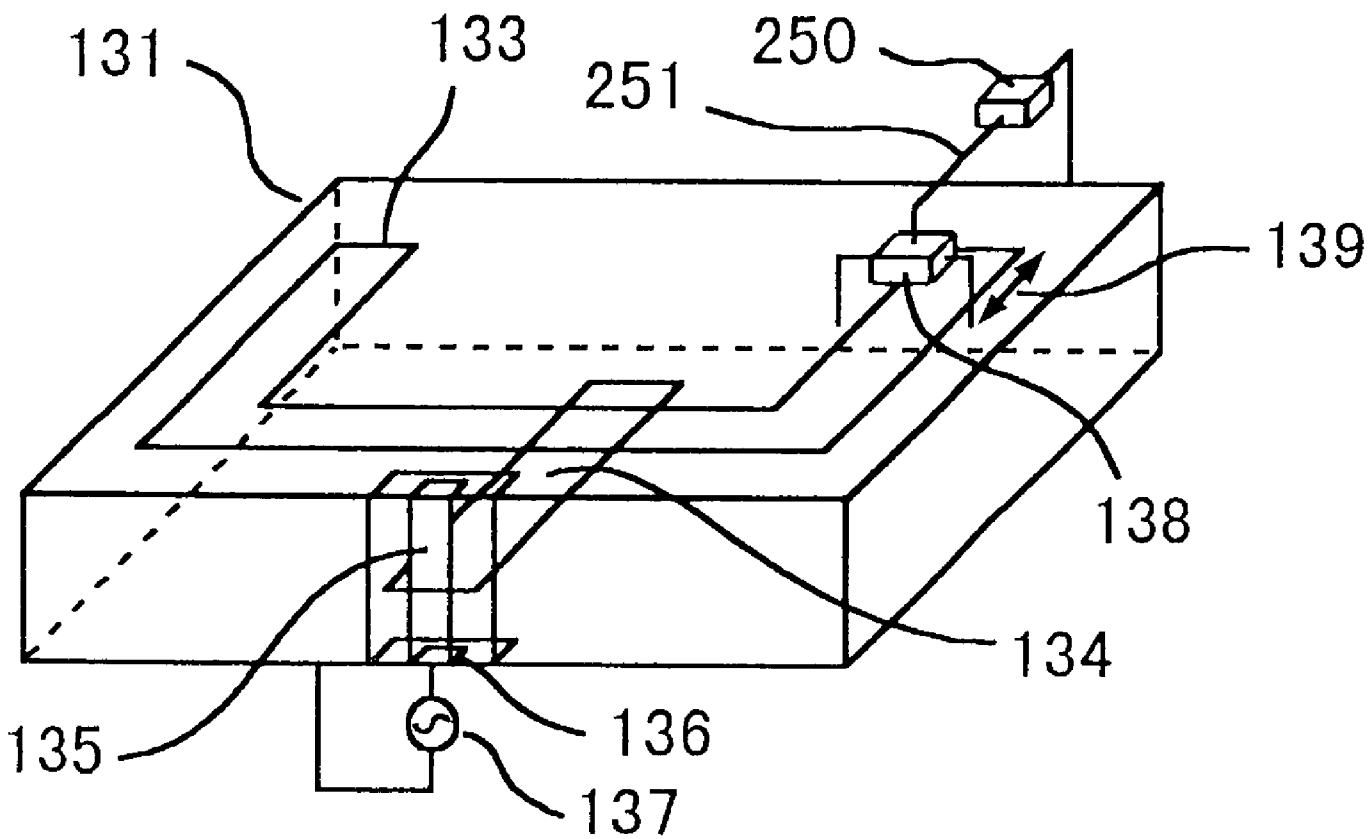
FIG. 8 is a perspective view for explaining a structure of a slot antenna according to the fourth embodiment.

An explanation will be given of the structure of the slot antennas for transmission and for receiving used in the embodiment in reference to FIG. 8. In FIG. 8, the slot antenna 131 is a slot antenna arranged with a slot 133 at a main face of a conductor box the surface of which is covered with a conductor and a strip-like conductor 134 is provided at inside of the conductor box to intersect with the slot and not to be brought into contact with the conductor box. One end of the strip-like conductor is connected to a side face electrode 135 provided at a side face of the conductor box. A side face conductor at a surrounding of the side face electrode is removed such that the side face electrode is not brought into contact with the side face conductor of the conductor box. One end of the side face conductor is connected to an island-like conductor 136 provided at a bottom face of the conductor box such that the island-like conductor 136 is not brought into contact with a conductor wall face. The island-like conductor constitutes an electricity feed point of the antenna and radio frequency power is supplied from an electricity feed circuit 137 to the electricity feed point by connecting the wall face of the conductor box to ground potential. Further, numeral 138 designates the variable impedance circuit and numeral 250 designates a control circuit for supplying a control signal to the variable impedance circuit. According to the variable impedance circuit, a pair of terminals thereof in which impedance across the terminals is changed, are respectively connected to conductors at both edges of the slot at a position remote from one end of the slot by constant distance 139 along the slot toward other end thereof and the control line 251 from the control-circuit is connected to the terminals for applying a control signal for changing the impedance across the terminals. By changing the control signal supplied from the control circuit, the central frequency of impedance matching of the antenna can be changed by changing the impedance between the conductors at the both edges of the slot at the above-described position.

Figure 9A:
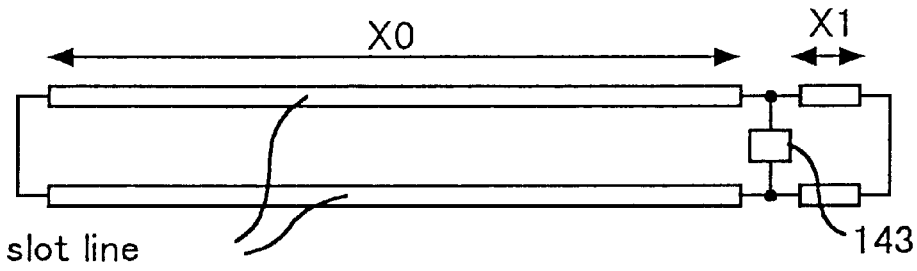
FIG. 9A shows an equivalent circuit of a slot portion of a slot antenna for explaining the principle of the antenna tuning system according to the fourth embodiment.
Figure 9B:
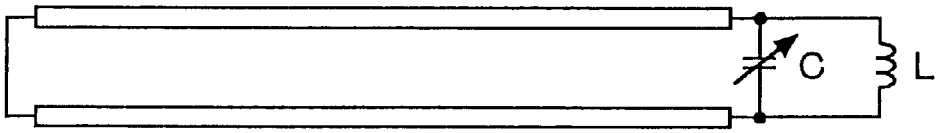
FIG. 9B shows an equivalent circuit of the slot portion in which a variable capacitance circuit is used as a variable impedance circuit in FIG. 9A.
Figure 9C:
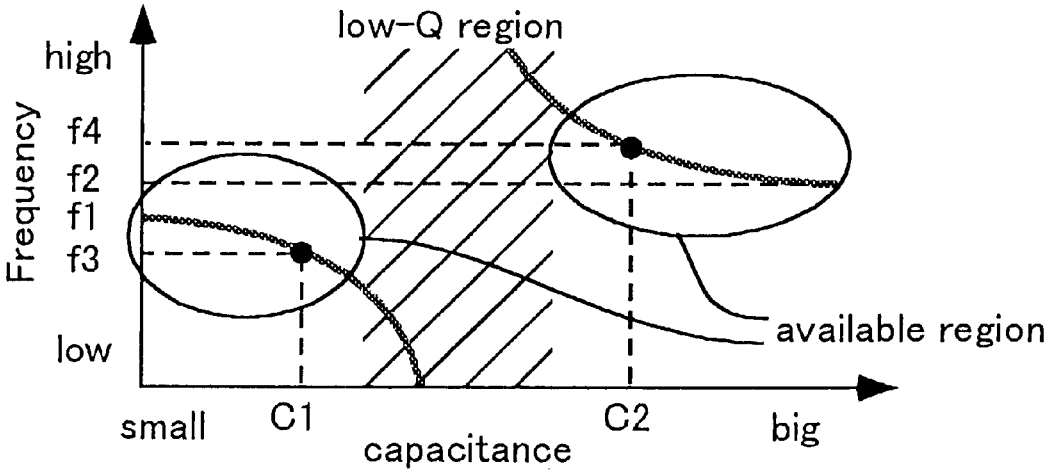
FIG. 9C shows resonance frequency characteristics with regard to a capacitance value C of the variable capacitance circuit in the equivalent circuit of FIG. 9B.

An explanation will be given of the principle of changing the central frequency of impedance matching, that is, the resonance frequency of the slot antenna by the antenna tuning system in reference to FIGS. 9A, 9B and 9C. FIGS. 9A, 9B and 9C show equivalent circuits of the slot antenna provided with the variable impedance circuit and the resonance frequency characteristic. FIG. 9A shows an equivalent circuit of the slot portion, FIG. 9B shows an equivalent circuit of the slot in which a variable capacitance circuit is used as the variable impedance circuit in FIG. 9A and a slot line path from a position remote from one end of the slot by a certain distance to the one end of the slot is approximated by inductance L and FIG. 9C shows the resonance frequency characteristic with regard to a capacitance value C of the variable capacitance circuit in the equivalent circuit of FIG. 9B. The resonance frequency of the slot antenna is substantially inversely proportional to the length of the slot line path. When the variable impedance circuit 138 is opened, the length of the slot line path is X0+X1 and the resonance frequency is f1 of FIG. 9C. When the variable impedance circuit is short-circuited, the slot line length is shortened to X0 and accordingly, the resonance frequency becomes higher to f2 of FIG. 9C. When the variable impedance circuit is represented by variable capacitance C and the slot line path from the above-described position to the one end of the slot is approximated by the inductance L, impedance Z synthesized by C and L is as shown by Equation (1).

$$Z=j\omega L/(1-\omega 2LC) \qquad \text{Equation (1)}$$

It is known from Equation (1) that as C increases to a certain value, the denominator is reduced and accordingly, Z seems to constitute a larger inductance component, when C increases from the certain value, Z becomes negative and accordingly, Z seems to constitute a small capacitance component and when C further increases, Z coincides with the value of C. Therefore, as C increases, the inductance component of the resonance frequency starting from f1 increases, that is, by extending the line path length equivalently from the length of X0+X1, the capacitance component is reduced and the capacitance component increases with a certain capacitance value as a boundary, that is, by making the line path length proximate to the state of X0 from a state in which the line path length becomes equivalently shorter than the length of X0, the frequency is settled to f2 by being reduced from high frequency. At regions before and after shifting Z from positive to negative as C increases, LC is brought into a resonance state, when there is loss in a variable impedance circuit, energy is dissipated there and accordingly, the resonance quality coefficient of Q value of the antenna is deteriorated. This region is not suitable for using the antenna and accordingly, the range excluding the region is made to constitute regions capable of using the slot antenna according to the antenna tuning system. When such a characteristic is utilized, for example, by connecting a capacitor element having a small capacitance value C1 between the conductors at the both edges of the slot in the above-described first position, the resonance frequency can be reduced from f1 to f3 and when a capacitor element having a large capacitance value C2 is connected to the position, the resonance frequency can be increased from f1 to f4. Therefore, according to the constitution, the resonance frequency of the antenna can be set to an arbitrary value by the capacitance value of the capacitor connected between the conductors at the both edges of the slot at the position remote from one end of the slot by a certain distance.

Embodiment 5

Figure 10:
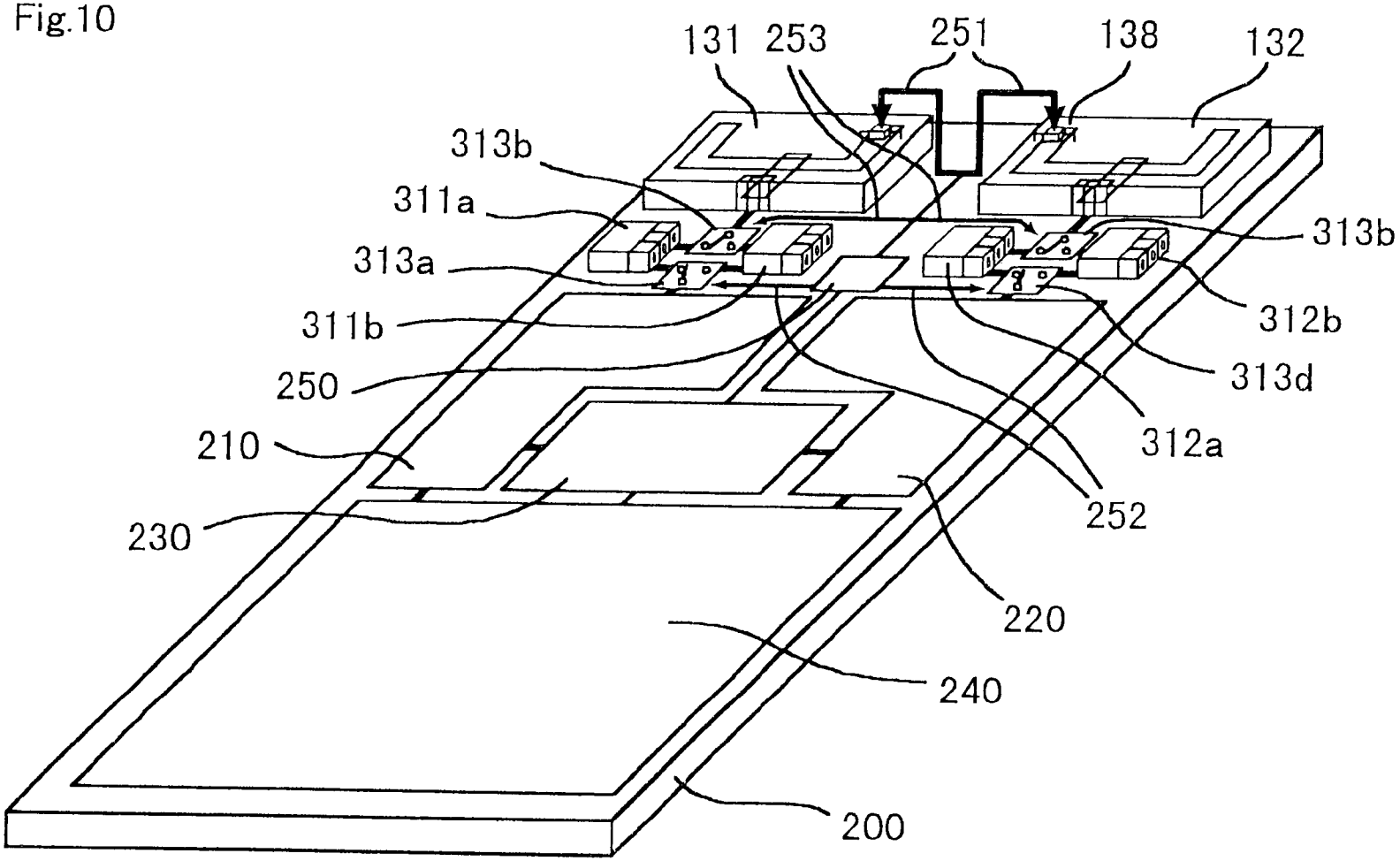
FIG. 10 is a perspective view for explaining a fifth embodiment of a wireless handset according to the present invention.

FIG. 10 shows an embodiment of a wireless handset using band switching type filter circuits in place of the filters for transmission and for receiving according to Embodiment 4. Notations 311*a* and 311*b* designate partial band filters for transmission respectively having different passbands, notations 312*a* and 312*b* designate partial band filters for receiving respectively having different passbands and notations 313*a*, 313*b*, 313*c* and 313*d* designate radio frequency switches.

The radio frequency circuit 210 for transmission is connected to a transmission tuning type slot antenna 131 via a transmission band switching type filter circuit constituted of the radio frequency switch 313*a*, the partial band filters for transmission 311*a* and 311*b* and the high frequency switch 313*b*. The receiving tuning type slot antenna 132 is connected to the radio frequency circuit for receiving 220 via a receiving band switching type filter circuit constituted of the radio frequency switch 313*c*, the partial band filters for receiving 312*a* and 312*b* and the radio frequency switch 313*d*. The central frequencies of impedance matching of the slot antennas of a transmission tuning type and a receiving tuning type, are controlled by applying control signals from the control circuit 250 connected to the synthesizer 230 to the variable impedance circuits 138 on the respective antennas via the control line 251. The bands of the band-switching type filter circuits are switched by applying control signals from the control circuit 250 to the radio frequency switches of the filter circuits of the transmission band switching type and the receiving band switching type via control lines 252 and 253. The control circuit 250 is provided on a region sandwiched between the transmission band switching type filter circuit and the receiving band switching type filter circuit or a region extended from the region in parallel with the long side of the circuit board.

Figure 11B:
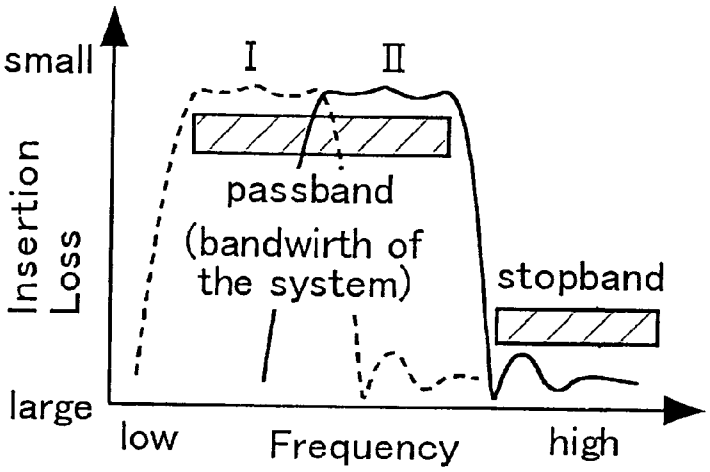
FIG. 11B shows filter band characteristics for explaining operation of a band-switching type filter according to the fifth embodiment.
Figure 11A:
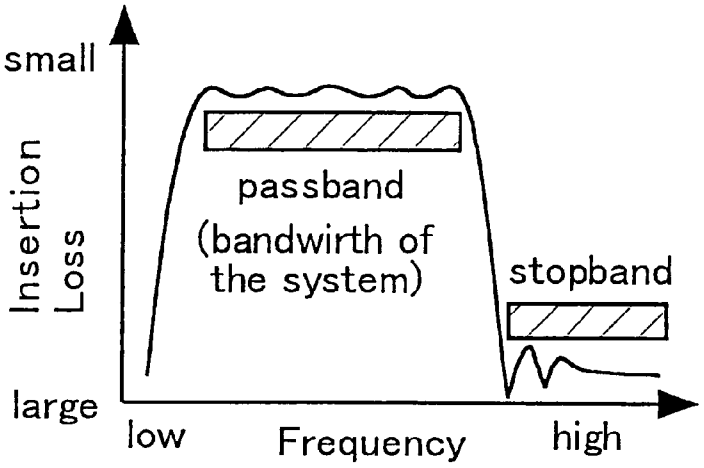
FIG. 11A shows filter band characteristics for explaining a behavior of covering a total of a system band by a fixed band filter.

An explanation will be given of band switching operation of the band switching type filter circuit in reference to FIGS. 11A and 11B. FIGS. 11A and 11B show a band characteristic (frequency versus insertion loss) of the filter in which FIG. 11A shows a behavior of covering a total of a system band by a fixed band filter and FIG. 11B shows a behavior of equivalently covering the system band by the band switching type filter circuits. Taking an example of the transmission band switching type filter circuit, when the partial band filter for transmission 311*a* is provided with band I and the partial band filter for transmission 311*b* is provided with band II, by switching the filter connected between the high frequency circuit for transmission and the transmission tuning type slot antenna to either of the filters 311*a* and 311*b* by controlling the radio frequency switches 313*a* and 313*b*, the passband of the filter can be set with frequency band necessary for operation. When the passband is not extremely narrower than that of used frequency, generally, a filter having a narrow passband can be realized more easily than a filter having a wide passband and further, the insertion loss can be reduced and accordingly, the insertion loss of power for transmission and for receiving can further be reduced and the battery capacitance is reduced to thereby enable to downsize the wireless handset. Similarly, insertion loss of power for receiving can further be reduced in the receiving system and accordingly, the minimum receiving power sensitivity of the wireless handset can be promoted.

In this case, when a number of states which can be provided by a tuning type slot antenna and a band covered thereby under a certain state are made coincident with a number of states which can be provided by another band switching type filter circuit and a passband under a certain state, the both can be controlled by the same control signal and accordingly, there is no need of providing a new control circuit.

Embodiment 6

Figure 12:
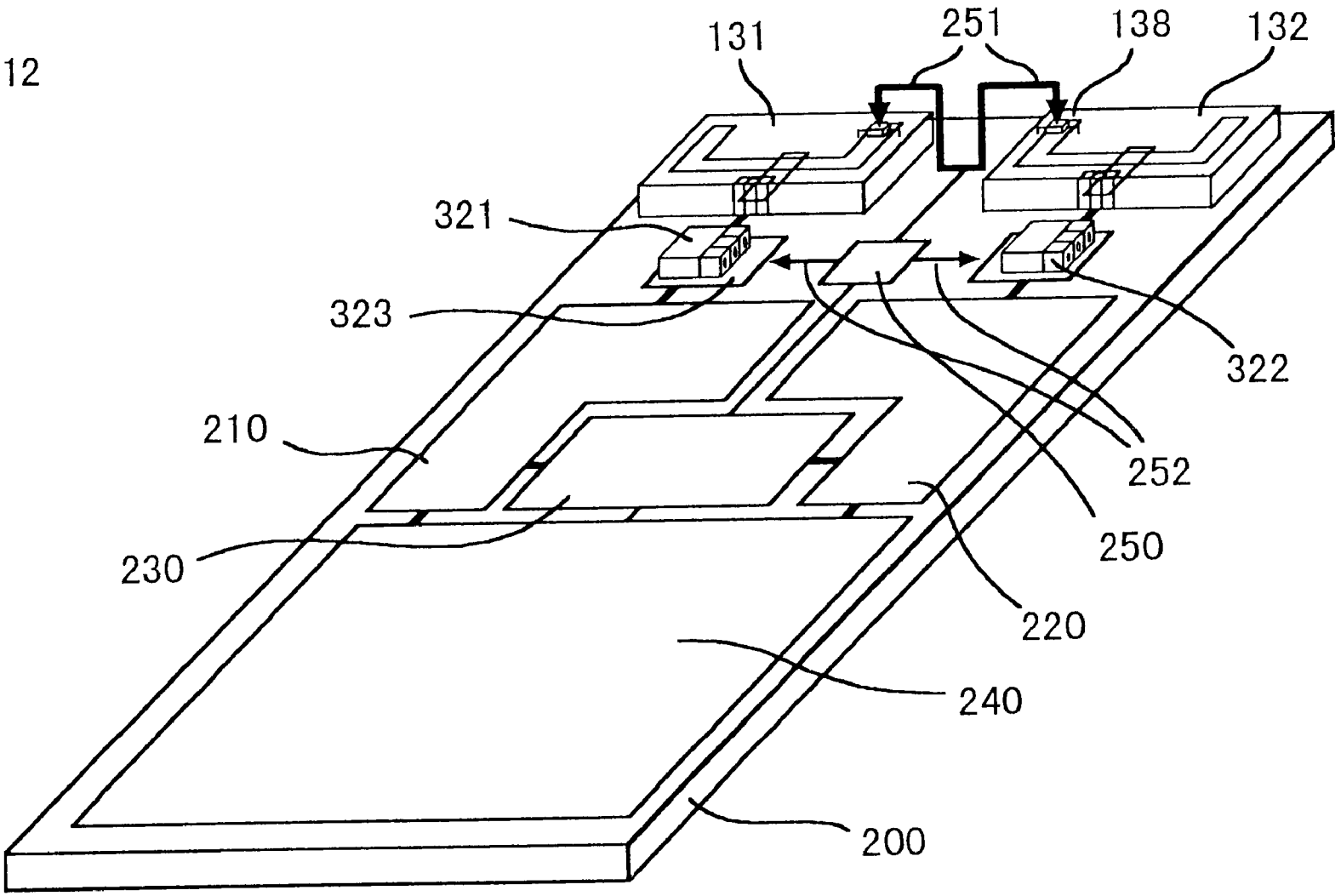
FIG. 12 is a perspective view for explaining a sixth embodiment of a wireless handset according to the present invention.
Figure 13:
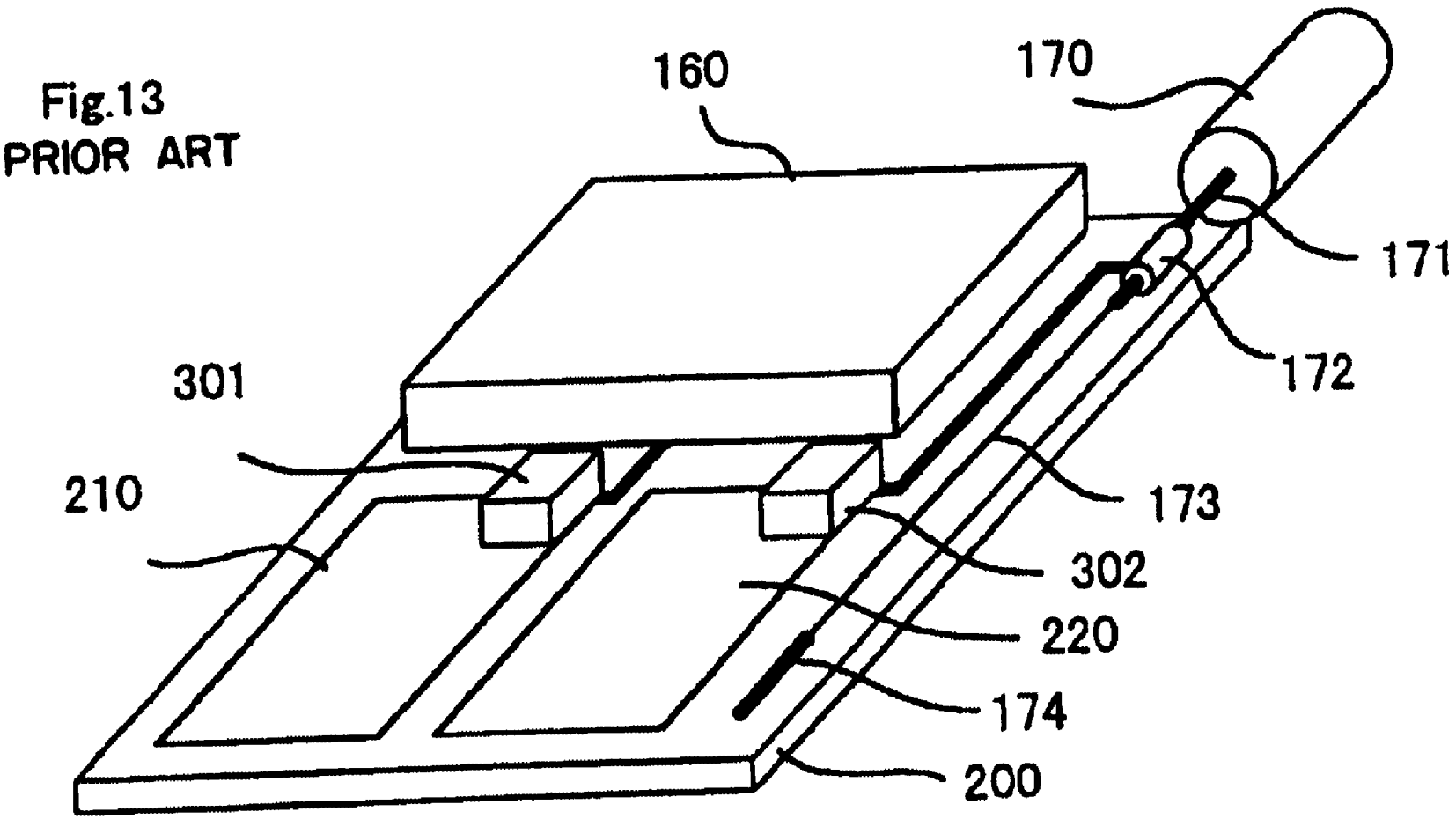
Fig.13 PRIOR ART
FIG. 13 is a perspective view for explaining a conventional wireless handset.

FIG. 12 shows another embodiment of a wireless handset using band switching type filter circuits in place of the filters for transmission and for receiving according to Embodiment 4. Numeral 321 designates a transmission band switching filter, numeral 322 designates a receiving band switching filter and the respective filters are connected with variable impedance circuits 323. Generally, a radio frequency filter is constituted of a plurality of resonators having different resonance frequencies. The passband and the stopnand are determined by resonance frequencies and connecting states of the resonators. Therefore, when the resonators are connected with variable impedance circuits and impedance of the variable impedance circuits are changed, the resonance frequencies of the resonators can be changed and the passband and the stopband can be changed.

By constructing such a constitution, a band switching type filter circuit can be realized by a constitution smaller than that in switching and using a plurality of filters and accordingly, the wireless handset can further be downsized and further, insertion loss can further be reduced by an amount of dispensing with high frequency switches which are needed in Embodiment 5.

According to the present invention, the wireless handset used in the communication system in which different frequencies for transmission and for receiving are simultaneously used, is provided with the magnetic current antenna for transmission and the magnetic current antenna for receiving arranged in parallel with each other such that the respective magnetic currents are disposed on a straight line and accordingly, there can be reduced signal leakage from the radio frequency circuit for transmission to the radio frequency circuit for receiving which becomes problematic in the wireless handset simultaneously carrying out transmission and receiving by minimizing the interference between the antennas for transmission and for receiving. Thereby, the attenuation amounts of stopbands of the radio frequency filters respectively provided between the antennas for transmission and for receiving and the transmission and receiving circuits can be alleviated and insertion loss of the passband can be reduced and accordingly, the wireless handset can be downsized by reducing the battery capacity owing to a reduction in loss of power for transmission and the minimum receiving power sensitivity of the wireless handset can be promoted owing to a reduction in loss of power for receiving.

Further, the wireless handset according to the present invention is provided with the antennas, the control circuit for changing the central frequencies of impedance matching of the antennas and the band switching type filter circuits connected to the antennas and capable of switching bands by the above-described control circuit and accordingly, by controlling the central frequencies of impedance matching of the antennas and the passbands of the band switching type filter circuits by the same control circuit, downsized formation owing to use of the narrow bandwidth antenna having a small volume and a reduction in insertion loss of power for transmission and receiving by use of the filters having narrow passbands and small insertion loss can simultaneously be realized.

Further, the wireless handset according to the present invention is provided with the antenna for transmission and the antenna for receiving having the same direction of main polarization and accordingly, a reduction in loss of passbands of the radio frequency filters respectively provided between the antennas for transmission and for receiving and the transmission and receiving circuits as well as efficient transmission and receiving in which respective directions of main polarization of the antennas for transmission and for receiving are aligned in the direction of main polarization in the system used in the wireless handset can be realized.

It is further understood by those skilled in the art that the foregoing description is a preferred embodiment of the disclosed device and that various changes and modifications may be made in the invention without departing from the spirit and scope thereof.

What is claimed is:

1. A wireless handset which is a wireless handset used in a communication system in which different frequencies for transmission and for receiving are simultaneously used, the wireless handset comprising:

a magnetic current antenna for transmission and a magnetic current antenna for receiving arranged in parallel with each other such that respective magnetic currents are disposed on a straight line.

2. The wireless handset according to claim 1, wherein said magnetic current antenna for transmission and said magnetic current antenna for receiving are slot antennas.

3. The wireless handset according to claim 1 or 2, wherein the magnetic current antenna for transmission and the magnetic current antenna for receiving are single-side directional antennas arranged to provide a directionality opposed to a user in using the wireless handset.

4. The wireless handset according to claim 1 or claim 2, further comprising a control circuit for changing central frequencies of impedance matching of said magnetic current antenna for transmission and the magnetic current antenna for receiving.

5. The wireless handset according to claim 4, wherein said magnetic current antenna for transmission and said magnetic current antenna for receiving are slot antennas each connected with a variable impedance circuit between conductors at both edges of a slot at a position remote from one end of the slot by a constant distance along the slot toward other end thereof and the central frequencies of impedance matching of the slot antennas are controlled by changing impedance of the variable impedance circuits by said control circuit.

6. The wireless handset according to claim 3, further comprising a control circuit for changing central frequencies of impedance matching of said magnetic current antenna for transmission and the magnetic current antenna for receiving.

7. The wireless handset according to claim 6, wherein said magnetic current antenna for transmission and said magnetic current antenna for receiving are slot antennas each connected with a variable impedance circuit between conductors at both edges of a slot at a position remote from one end of the slot by a constant distance along the slot toward other end thereof and the central frequencies of impedance matching of the slot antennas are controlled by changing impedance of the variable impedance circuits by said control circuit.

8. The wireless handset according to claim 1, wherein said magnetic current antenna for transmission and said magnetic current antenna for receiving are micro strip antennas.

9. The wireless handset according to claim 1 or claim 8, wherein the magnetic current antenna for transmission and the magnetic current antenna for receiving are single-side directional antennas arranged to provide a directionality opposed to a user in using the wireless handset.

10. The wireless handset according to claim 1 or claim 8, further comprising a control circuit for changing central frequencies of impedance matching of said magnetic current antenna for transmission and the magnetic current antenna for receiving.

11. The wireless handset according to claim 9, further comprising a control circuit for changing central frequencies of impedance matching of said magnetic current antenna for transmission and the magnetic current antenna for receiving.

12. The wireless handset according to claim 10, wherein said magnetic current antenna for transmission and said magnetic current antenna for receiving are slot antennas each connected with a variable impedance circuit between conductors at both edges of a slot at a position remote from one end of the slot by a constant distance along the slot toward other end thereof and the central frequencies of impedance matching of the slot antennas are controlled by changing impedance of the variable impedance circuits by said control circuit.

13. The wireless handset according to claim 11, wherein said magnetic current antenna for transmission and said magnetic current antenna for receiving are slot antennas each connected with a variable impedance circuit between conductors at both edges of a slot at a position remote from one end of the slot by a constant distance along the slot toward other end thereof and the central frequencies of impedance matching of the slot antennas are controlled by changing impedance of the variable impedance circuits by the said control circuit.

14. A wireless handset comprising:

antennas;

a control circuit for changing central frequencies of impedance matching of the antennas; and band switching type filter circuits connected to the antennas, bands of the filter circuits being switched by the control circuit.

15. The wireless handset according to claim 14, wherein said band switching type filter circuit comprises a plurality of filters having different bands and switches for switching the plurality of filters.

16. The wireless handset according to claim 14, wherein said band switching type filter circuit comprises:

a filter; and a variable impedance circuit for changing impedance of the filter;

wherein the variable impedance circuit is controlled by the control circuit.

17. A wireless handset comprising:

an antenna for transmission; and an antenna for receiving;

wherein directions of main polarization of the antenna for transmission and the antenna for receiving are the same as each other.

18. A wireless handset comprising:

a circuit board in a rectangular shape;

an antenna for transmission and an antenna for receiving arranged in parallel with each other and in parallel with a short side of the circuit board;

variable impedance circuits respectively provided to the antenna for transmission and the antenna for receiving; and a control circuit connected to the variable impedance circuits;

wherein the control circuit is provided at a region sandwiched between the antenna for transmission and the antenna for receiving.

19. A wireless handset comprising:

antennas;

a circuit board in a rectangular shape;

a transmission band switching type filter circuit and a receiving band switching type filter circuit connected to the antennas and arranged in parallel with each other and in parallel with a short side of the circuit board; and a control circuit connected to the transmission band switching type filter circuit and the receiving band switching type filter circuit;

wherein the control circuit is provided at a region sandwiched between the transmission band switching type filter circuit and the receiving band switching type filter circuit.

20. A wireless handset comprising:

a circuit board in a rectangular shape;

an antenna for transmission and an antenna for receiving arranged in parallel with each other and in parallel with a short side of the circuit board;

variable impedance circuits respectively provided to the antenna for transmission and the antenna for receiving; and a control circuit connected to the variable impedance circuits, wherein the control circuit is provided at a region extended from the region in parallel with a long side of the circuit board.

21. A wireless handset comprising:

antennas;

a circuit board in a rectangular shape;

a transmission band switching type filter circuit and a receiving band switching type filter circuit connected to the antennas and arranged in parallel with each other and in parallel with a short side of the circuit board; and a control circuit connected to the transmission band switching type filter circuit and the receiving band switching type filter circuit, wherein the control circuit is provided at a region extended from the region in parallel with a long side of the circuit board.

* * * * *